United States Patent [19]

Briggs

[11] Patent Number: 4,616,749

[45] Date of Patent: Oct. 14, 1986

[54] GOLF CLUB CARRIER AND HOLDER

[76] Inventor: Cyril F. Briggs, 1450 Inverness, Adrian, Mich. 49221

[21] Appl. No.: 692,404

[22] Filed: Jan. 17, 1985

[51] Int. Cl.[4] ..... A63B 55/00

[52] U.S. Cl. ..... 206/315.2; 206/443; 248/121; 248/251

[58] Field of Search ..... 206/315.2, 443; 248/121, 371, 398, 251

[56] References Cited

U.S. PATENT DOCUMENTS

| | | | |
|---|---|---|---|
| 1,314,171 | 8/1919 | Vogel | 206/315.2 |
| 2,590,154 | 3/1952 | Burns | 206/315.2 |
| 2,887,137 | 5/1959 | Robb | 206/315.2 |
| 2,990,865 | 7/1961 | Steele | 206/315.2 |
| 3,058,504 | 10/1962 | Powers | 206/315.2 |
| 3,215,181 | 11/1965 | Reed | 206/315.2 |
| 3,219,083 | 11/1965 | Asquith | 206/315.2 |
| 4,154,274 | 5/1979 | Adamson | 206/315.2 |
| 4,181,220 | 1/1980 | Zicko | 206/315.2 |
| 4,317,477 | 3/1982 | Baptista | 206/315.2 |
| 4,319,616 | 3/1982 | Light | 206/315.2 |

*Primary Examiner*—Joseph Man-Fu Moy

*Attorney, Agent, or Firm*—Gifford, Groh, VanOphem, Sheridan, Sprinkle & Sprinkle

[57] ABSTRACT

A lightweight golf club carrier for transporting and retaining a plurality of golf clubs while preventing the grips of the clubs from lying on the ground when the device is placed on the ground. The carrier comprises a substantially planar body having a pair of downwardly extending legs and a series of lateral supports. The legs and supports have a generally U-shaped cross section to reduce the weight of the device while providing sufficient strength. Four channels are formed in the peripheral edge of the device for retaining the individual golf clubs and the legs and lateral supports define an opening which allows the device to be grasped and carried.

5 Claims, 3 Drawing Figures

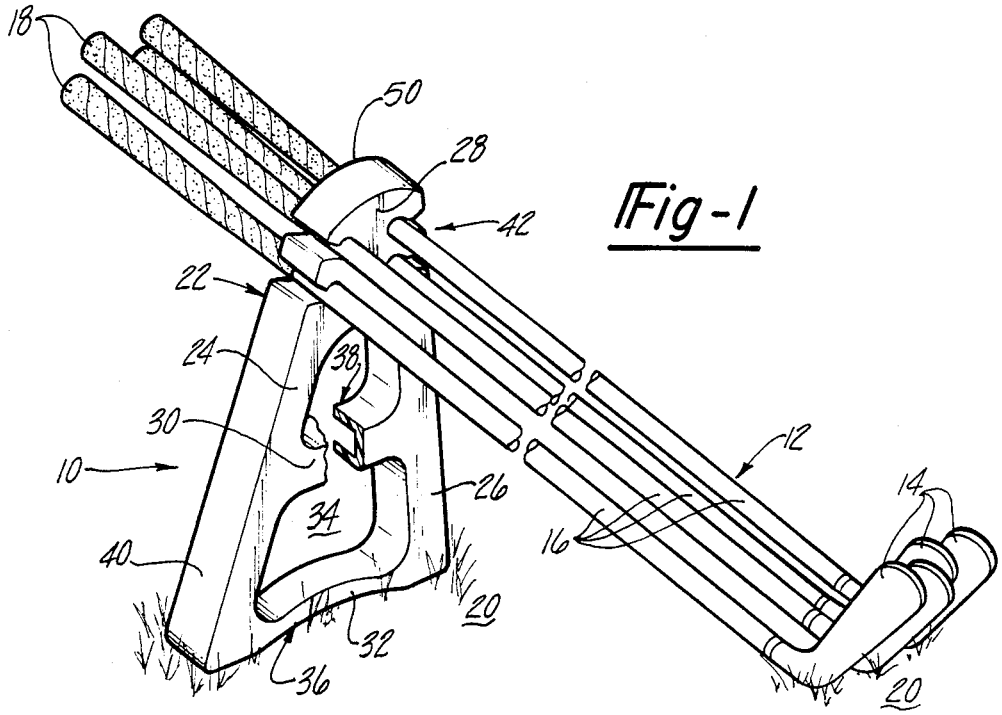
Fig-1
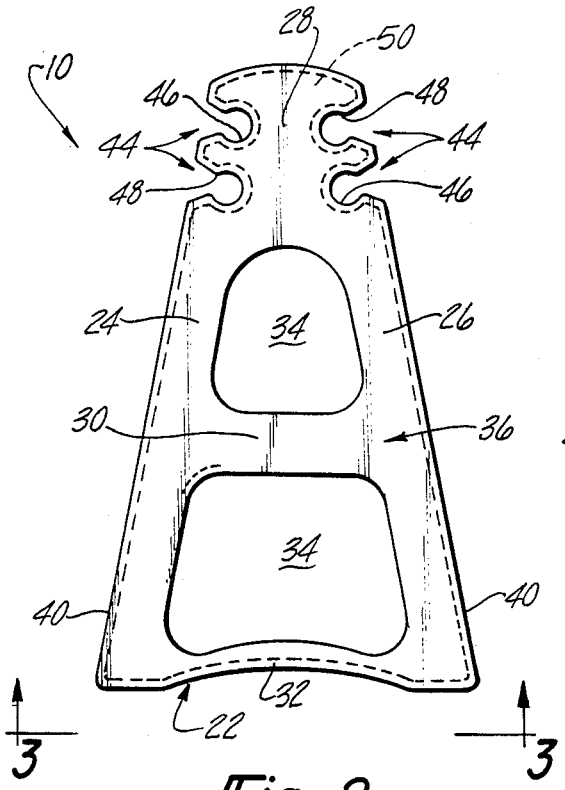
Fig-2
Fig-3
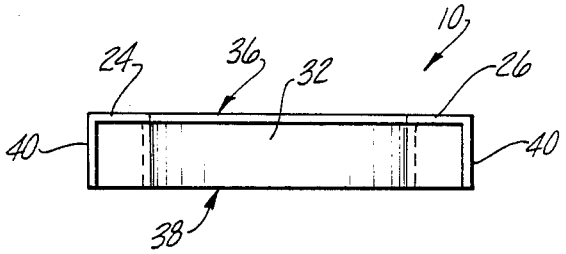

GOLF CLUB CARRIER AND HOLDER

BACKGROUND OF THE INVENTION

I. Field of the Invention

This invention relates to carrying devices and, in particular, to a golf club carrier and holder which retains a minimum number of golf clubs while preventing the grips of the clubs from contacting the ground.

II. Description of the Prior Art

A wide variety of means are utilized to retain and transport golf clubs during a round of golf. The devices range from mechanized golf carts and cumbersome golf bags to simple devices for carrying one or two clubs. Although in tournament play as well as recreational matches it may be necessary to have a full set of golf clubs and therefore a golf bag and cart, many times it is not necessary to carry a full set and a few carefully chosen clubs will suffice. In addition to greatly reducing the weight which must be carried during play, the expense of a full set of clubs and a bag may be prohibitive to the beginning golfer. Thus, it can be advantageous to the beginning golfer or when a quick practice round is desired for the veteran golfer, to carry and retain only a minimum number of clubs during the round. Generally, all that is required may be a driver, a putter and one or two irons.

Noting the need for a simple device to carry a minimum number of golf clubs, prior art devices range widely in their versatility and function. Most prior art carriers for this purpose utilize one or more tubes, which accept the shaft of the club, to carry several clubs. These tubes are generally aligned parallel to one another in order to separate the clubs and are very long to prevent the clubs from slipping out of the carrier. The length and width of these tubes increases the size and weight of the carrier and many such carriers approach the bulkiness of a golf bag. Moreover, the length of the tubes does not prevent the clubs from falling from the carrier when the device is inverted or tilted at a severe angle.

Other prior art devices utilize a series of clips which snugly fit around the club shaft to retain the clubs. Generally, these clips are secured to a metal frame for support. However, in the devices of this type known to applicant, the grips of the clubs are prevented from contacting the ground and turf by driving one or more spikes into the turf to support the carrier. Clearly, because of the characteristics of a golf course it would be advantageous to avoid damaging the turf. By repeatedly placing and removing the spiked carriers the possibility of damage to the course is increased, particularly in sensitive areas such as the fairways and greens. Also such carriers depend upon good penetration of the spikes into the ground and if the ground is dry and/or hard this may be difficult to achieve.

SUMMARY OF THE PRESENT INVENTION

The present invention is an improved golf club carrier and holder which overcomes the disadvantages of the previously known devices for this purpose.

The golf club carrier and holder according to the present invention comprises a generally triangular body formed by a pair of downwardly extending legs and at least one lateral support. The legs and supports have a substantially U-shaped transverse cross section in order to provide sufficient strength while reducing the overall weight of the device. The cross section of the legs and supports forms a substantially planar first surface and a grooved opposite surface.

Four or more transverse grooves are formed in the peripheral edge of the body for retaining a set of golf clubs. The grooves preferably comprise an annular throughbore and a narrowed neck portion for placing the club shaft within the throughbore. In addition, the apex of the legs and the lateral supports form an opening which permits the user to grasp and carry the device. When not being transported, the carrier and clubs may be placed on the ground such that the bottom of the device and the club heads rest on the ground while the opposite ends of the clubs are spaced upwardly from the ground thereby preventing the club shaft and grip from becoming wet or muddy.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of the preferred embodiment of the present invention when read in conjunction with the accompanying drawing, in which like reference characters refer to like parts throughout the views, and in which:

FIG. 1 is a perspective view of the preferred embodiment of the present invention in use;

FIG. 2 is a front elevational view of the present invention; and

FIG. 3 is a bottom view of the present invention taken along line 3—3 of FIG. 2.

DETAILED DESCRIPTION OF THE PRESENT INVENTION

Referring to FIG. 1, there is shown a golf club carrier 10 embodying the present invention. The carrier 10 is shown with golf clubs 12 each having a club head 14, a shaft 16, and a grip 18. FIG. 1 shows the carrier 10 and the club heads 14 engaging the ground 20 in a resting position. The grips 18 are spaced upwardly from the ground. Use of the present invention will be subsequently described herein.

Referring now to FIGS. 1 and 2, the carrier 10 comprises a body 22 which includes a pair of downwardly extending legs 24 and 26 joined at an apex 28. The body 22 further comprises lateral supports 30 and 32 which connect the legs 24 and 26. The lateral supports 30 and 32 together with the legs 24 and 26 define openings 34 which facilitate grasping and carrying of the device 10 as will be subsequently described. The body 22 is preferably made of plastic to reduce the weight and manufacturing costs of the device. In the alternative, the device may be made of wood or a similar lightweight material.

As is best shown in FIGS. 1 and 3, the legs 24 and 26 as well as the lateral supports 30 and 32 have a substantially U-shaped transverse cross section thereby forming a substantially planar front surface 36 and a channeled back surface 38. The channeled or U-shaped construction of the body 22 reduces the overall weight of the device 10 thereby making the device easier to handle and carry. Similarly, the openings 34 also reduce the weight of the device 10 as well as reducing material and manufacturing costs. However, it is to be understood that the body 22 may be constructed in any manner, including utilizing hollow or tubular as opposed to channeled legs and supports or constructing the device to include only one support 32 thereby defining one opening 34. Moreover, the body 22 may be substantially planar without any openings 34.

The legs 24 and 26 define a peripheral edge 40 of the body 22 which extends up one leg 24, over the apex 28, and down the other leg 26. Found along the upper portion of this peripheral edge 40 is the golf club retaining means 42 which preferably comprises a plurality of channels 44 removed from the peripheral edge 40 and formed perpendicular to the surface 36 of the body 22. As is best shown in FIG. 2, the channels 44 comprise a substantially annular throughbore 46 and a reduced neck portion 48. The neck portion 48 retains the golf club 12 within the annular throughbore 46 as will be subsequently described. The preferred embodiment shown in the drawings employs four channels 44 which can retain a sufficient number of golf clubs 12 to play a round of golf. It should be apparent however that the device could include more or less channels 44 as desired. Moreover, in the alternative, the channels 44 can be replaced with a series of resilient clips (not shown) secured to the peripheral edge 40 which could be utilized to retain the clubs 12.

Use of the golf club carrier 10 of the present invention is simple and convenient. The clubs 12 are placed within the individual channels 44 by first guiding the club shaft 16 through the narrowed portion 48 of the channel 44. The club 12 is then shifted longitudinally through the annular bore 46 until the grip 18 of the club 12 fits snuggly within the bore 46. Since the shaft 16 and the grip 18 of the standard golf club 12 have a tapered construction increasing in cross section toward the end of the shaft 16 provided with the grip 18, the further the club 12 is shifted to move the club head 14 away from the carrier 10 the tighter the fit will be within the channel 44. Once the chosen clubs 12 are in place, the carrier 10 can be grasped by the top of the body 22 wherein there is formed a convenient means 50 for grasping the device 10. In the preferred embodiment the grasping means 50 is formed by the apex 28 of the legs 24 and 26 and the channel construction of the body 22. Alternatively, the device 10 may be grasped and carried by one of the openings 34 formed in the body 22 or it can be grasped and carried by grasping the support 32. Because the clubs 12 can be tightly fitted to the carrier 10, the shaft 16 of the clubs 12 can be grasped and the club 12 and holder 10 can be carried on the shoulder.

As is shown in FIG. 1, when it becomes necessary to place the carrier 10 on the ground 20, the club shafts 16 and grips 18 are prevented from contacting the ground 20. In its resting position, the carrier 10 and clubs 12 form a tripod with only the bottom of the carrier 10 and the club heads 14 contacting the ground 20. After the golf shot, the club 12 is placed in the channel 44 and the carrier 10 and clubs 12 and the holder 10 are again grasped and transported to the next location.

Thus, the golf club carrier of the present invention provides a simple and lightweight device for retaining and transporting a minimum number of clubs during a round of golf. The device is lightweight and convenient, and it may be utilized anywhere on the golf course without causing damage to the playing surface. Moreover, additional features may be added to the device to further enhance the versatility of the invention, including means for retaining tees and balls. Additionally, the size of the carrier allows the device to be conveniently stored in an automobile or a locker.

The foregoing detailed description has been given for clarity of understanding only and no unnecessary limitations should be understood therefrom. The invention is defined by the following claims.

I claim:

1. A golf club carrier for transporting and retaining a plurality of golf clubs each having a club head, a shaft and a grip, said grip being of a layered cross-section across the end of said shaft, said carrier comprising:

a body having a pair of downwardly extending legs, each leg having a first end and a second end, said first ends of said legs being joined at an apex at a top of said body and at least one lateral support extending between said legs wherein said legs and said support form first and second surfaces of said body and a peripheral edge, each leg further comprising an elongated planar portion;

said body being of a one piece molded construction, means formed in said body for retaining a plurality of golf clubs, said retaining means comprising a plurality of notches formed in said peripheral edge, said notches being generally perpendicular to said first and second surfaces and wherein said notches extend through said body, said notches being formed at said apex of said body so that either leg can be freely grasped between said retaining means and said first end of said either leg;

wherein said planar portion of each leg extends continuously from said retaining means to said second end of each leg and forms a means for grasping and transporting said carrier, said grasping and transporting means being integrally formed in said body;

said notches having a cross-sectional area to disengagingly receive said shaft of said club but to engage said grip to retain said club when said club is moved in a longitudinal direction to bring said grip into said retaining means wherein with the grips of golf clubs positioned in said notches and said carrier positioned on a ground support surface, said carrier together with said clubs form a stand in which said second ends of said legs and the club heads of the clubs abut against and are supported by the ground surface.

2. The carrier as defined in claim 1 and in which an opening is formed in said body between said legs and said lateral support.

3. The golf club carrier as defined in claim 1 and comprising a further grasping means formed at the top of said apex.

4. The golf club carrier as defined in claim 1 wherein said plurality of notches is four.

5. The golf club carrier as defined in claim 1 wherein said body is constructed of a lightweight plastic material.

* * * * *